US008181318B2

(12) United States Patent
Anscher

(10) Patent No.: US 8,181,318 B2
(45) Date of Patent: May 22, 2012

(54) BUCKLE ASSEMBLY

(75) Inventor: Joseph Anscher, Muttontown, NY (US)

(73) Assignee: National Molding LLC, Miami Lakes, FL (US)

( * ) Notice: Subject to any disclaimer, the term of this patent is extended or adjusted under 35 U.S.C. 154(b) by 0 days.

(21) Appl. No.: 12/807,384

(22) Filed: Sep. 3, 2010

(65) Prior Publication Data

US 2012/0054993 A1 Mar. 8, 2012

(51) Int. Cl.
*A44B 11/25* (2006.01)

(52) U.S. Cl. ..... 24/634; 24/640

(58) Field of Classification Search ..... 24/634, 24/631, 639, 640, 642, 633, 629, 614, 615, 24/701, 603, 164, 595.1, 230, 632, 645, 650; 244/122 B; 224/161; 180/268; 11/25; *A44B 11/25*
See application file for complete search history.

(56) References Cited

U.S. PATENT DOCUMENTS

| | | | | |
|---|---|---|---|---|
| 3,200,463 | A | 8/1965 | Craven et al. | |
| 5,086,548 | A * | 2/1992 | Tanaka et al. | 24/632 |
| 5,275,437 | A * | 1/1994 | Modinger et al. | 280/806 |
| 5,465,472 | A | 11/1995 | Matoba | |
| 5,511,856 | A * | 4/1996 | Merrick et al. | 297/476 |
| 5,604,964 | A * | 2/1997 | Aoshima | 24/632 |
| 5,832,573 | A | 11/1998 | Howell | |
| 6,148,486 | A * | 11/2000 | Uehara et al. | 24/170 |
| 6,170,133 | B1 * | 1/2001 | Uehara | 24/614 |
| 6,363,590 | B1 * | 4/2002 | Lan | 24/614 |
| 6,487,761 | B2 | 12/2002 | Van Tassel | |
| 6,769,137 | B2 | 8/2004 | D'Annunzio | |
| 6,796,007 | B1 * | 9/2004 | Anscher | 24/633 |
| 7,047,570 | B2 | 5/2006 | Johnson | |
| 7,073,234 | B2 | 7/2006 | Turpin | |
| 7,096,545 | B2 | 8/2006 | Uehara et al. | |
| 7,243,376 | B2 | 7/2007 | Johnson | |
| 7,360,287 | B2 * | 4/2008 | Cerruti et al. | 24/633 |
| 7,424,748 | B1 | 9/2008 | McDunn et al. | |
| 7,520,036 | B1 * | 4/2009 | Baldwin et al. | 24/635 |
| 2007/0283539 | A1 * | 12/2007 | Pezza | 24/640 |
| 2009/0038125 | A1 * | 2/2009 | Wu | 24/633 |
| 2009/0038126 | A1 * | 2/2009 | Krauss et al. | 24/633 |
| 2010/0101060 | A1 * | 4/2010 | Walega et al. | 24/603 |
| 2010/0237112 | A1 * | 9/2010 | Zhang | 224/161 |
| 2011/0162177 | A1 * | 7/2011 | Von Der Ahe et al. | 24/641 |
| 2011/0247180 | A1 * | 10/2011 | Duong et al. | 24/164 |

FOREIGN PATENT DOCUMENTS

| | | |
|---|---|---|
| DE | 1 849 648 | 4/1962 |
| DE | 10 2007 058 124 | 6/2009 |
| WO | WO 2008/094280 | 8/2008 |
| WO | WO 2009/047790 | 4/2009 |

OTHER PUBLICATIONS

European Search Report dated Aug. 20, 2010.

* cited by examiner

*Primary Examiner* — Robert J Sandy
*Assistant Examiner* — Louis Mercado
(74) *Attorney, Agent, or Firm* — Collard & Roe, P.C.

(57) ABSTRACT

A buckle assembly has a female buckle portion formed by a housing with a hollow interior and at least two openings, and at least two male buckle portions, each having at least one locking leg. There is an actuating device disposed within the housing and accessible through an aperture in the housing. The actuating device has latching mechanisms for cooperating with the locking legs for locking the male buckle portions within the female buckle portion when the locking legs of the male portions are inserted through the openings of the housing. Pulling the actuating device toward the aperture moves the latching mechanisms away from the male buckle portions and releases the male buckle portions from the housing.

16 Claims, 9 Drawing Sheets

BUCKLE ASSEMBLY

BACKGROUND OF THE INVENTION

1. Field of the Invention

This invention relates to a buckle assembly having a female buckle portion that can be secured to a corresponding male buckle portion. The female buckle portion according to the invention can accommodate multiple male buckle portions at once, and has a release mechanism for releasing all of the attached male buckle portions with a single movement.

2. The Prior Art

In a standard two-piece buckle, a male portion is snapped into a female portion and is then released, either by pushing a central button, pulling a lever, or squeezing locking legs of the male portion together. In certain applications, it is desired to have male and female buckles engaged in one location, for example in the small of one's back, yet have the ability to release the buckles in a more accessible area, such as near the shoulder, while making the system with as low a profile as possible. This system would be of particular advantage with cut-away tactical vests worn by the military and law enforcement, where a cummerbund or hip belt needs to be disassembled from the back but the release mechanism can be placed in a more accessible area. It is important that all of the buckles be released simultaneously to free the wearer from the vest, but the system must be secure enough so that the buckles are not inadvertently released while the wearer is moving through obstacles.

SUMMARY OF THE INVENTION

It is therefore an object of the invention to provide a female buckle portion that allows at least one male buckle portion to be released simultaneously with a single movement from a remote location.

These and other objects are accomplished by a buckle assembly comprising a female buckle portion formed by a housing with a hollow interior and at least one opening, and at least one male buckle portion having at least one locking leg. There is an actuating device disposed within the housing and accessible through an aperture in the housing. The actuating device has latching mechanisms for cooperating with the locking legs for locking the male buckle portions within the female buckle portion when the locking legs of the male portions are inserted through the openings of the housing. Pulling the actuating device toward the aperture moves the latching mechanisms away from the male buckle portions and releases the male buckle portions from the housing. The actuating device can be connected to a cable having a handle on one end, so that the handle can be disposed in a remote location from the female buckle portion.

In a preferred embodiment, the actuating device has sliding surfaces that slide against the male buckle portions when the actuating device is pulled, to push the male buckle portions out of the female buckle portion. These sliding surfaces can be located on an opposite side of the male buckle portions from the at least one latching mechanism, so that while the latching mechanism is releasing the male buckle portion on one side, it is being pushed out via pressure on the other side as well.

In one embodiment, the locking legs on the male portion have a locking pawl on a free end, and the latching mechanism comprises a protrusion that interacts with the locking pawl to prevent the male buckle portion from exiting the female buckle portion. Pulling on the actuating device pulls the protrusion away from the locking pawl to release the male buckle portion.

To further secure the male buckle portions inside the female buckle portion, there can be two additional latching mechanisms disposed in the housing opposite the latching mechanisms on the actuating device, such that inserting the male buckle portions through the openings causes the latching mechanisms on the actuating device to engage one side of the male buckle portions, and the latching mechanism on the housing to engage an opposite side of the male buckle portions. This is particularly effective if the male buckle portions each have two locking legs. This way, the latching mechanism on the actuating device engages one locking leg, and the latching mechanism on the housing engages the other locking leg of each male portion. The sliding surfaces push the male buckle portions out of engagement with these additional latching mechanisms when the actuating device is pulled. In another embodiment, the latching mechanisms are located only on the housing, and not on the actuating device. Pulling upward on the actuating device causes sliding surfaces on the actuating device to free the male locking legs from the latching mechanisms on the housing, and release the male buckle portions.

To keep the actuating device in a pre-loaded position, there can be at least one spring disposed within the housing and which presses the actuating device away from the aperture, so that the male buckle portions snap into the actuating device when the male buckle portions are inserted through the openings. The upward pressure on the actuating device from pulling the actuating device must be sufficient to overcome the force of the springs in order to release the male buckle portions. This prevents inadvertent release of the male portions.

In one embodiment, there are two male buckle portions, two openings in the housing, and two latching mechanisms on the actuating device, such that pulling the actuating device releases all four male portions simultaneously. In another embodiment, there are four male buckle portions, four openings in the housing, and four latching mechanisms on the actuating device, such that pulling the actuating device releases all four male portions simultaneously.

The buckle assembly according to the invention is particularly suited for attaching to additional similar buckle assemblies, to create a "daisy chain", where pulling on a single actuating mechanism pulls the actuating mechanisms of all attached buckle assemblies. This works by attaching a front end of one actuating device on one buckle assembly, to a rear end of an actuating device on an adjacent buckle assembly, so that pulling on one actuating device pulls the second actuating device also.

To keep the actuating device mounted securely within the female portion, the actuating device can be equipped with a central channel through which guidance pins on the housing extend. These guidance pins allow the actuating device to slide in a single axial direction to allow the actuating device to release the male buckle portions, but prevent any lateral movement within the female buckle portion.

In one embodiment, the actuating device is disposed entirely within the female portion, and is attached to a cable that extends through the aperture in the female portion. Pulling the cable pulls the actuating device.

In another embodiment, the actuating device acts on additional mechanisms within the female portion to release additional buckles. In this embodiment, there is at least one lever mounted within the housing. The lever has a fulcrum and two free ends; one free end is connected to a cable and the other free end is disposed so that the actuating device contacts this other free end and pivots the lever when the actuating device is pulled, thus pulling the cable. The cable is connected to a male buckle portion, so that pulling the actuating device pulls the male buckle portion connected to the cable and releases it from a corresponding female portion. Ideally, there are two of these levers, each lever being connected to a cable that is connected to a male buckle portion.

In another embodiment, there is at least one cable connected to the actuating device, and extending through the housing, and at least one cable guide connected to the housing, so that pulling the actuating device pulls the one cable and causes the one cable to slide along the one cable guide. There can be another male buckle portion connected to the cable, so that pulling the actuating device also pulls this other male buckle portion. Ideally, there are two cables, two cable guides, and a male buckle portion connected to each of the cables.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
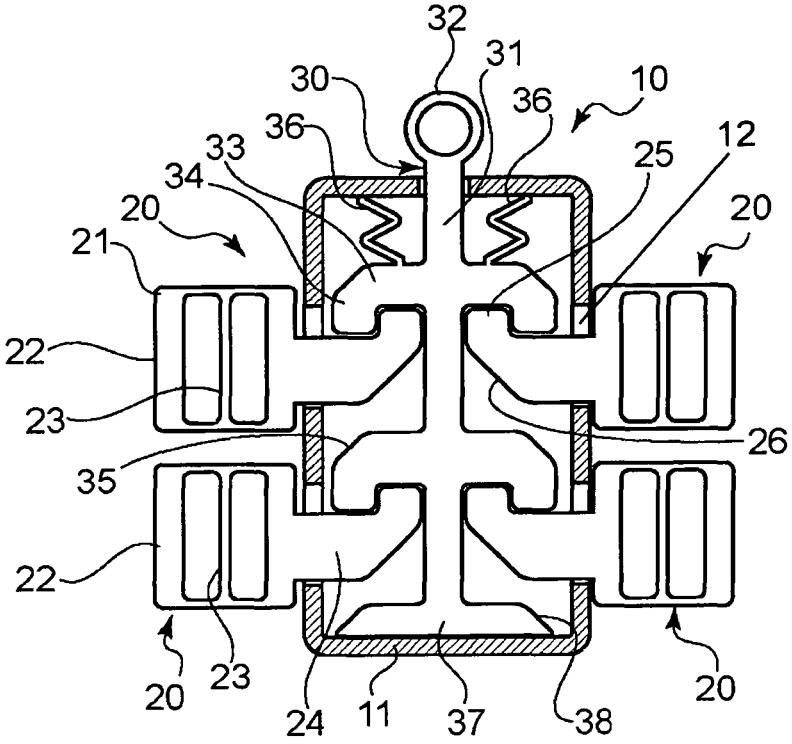
FIG. 1 shows a front cross-sectional view of one embodiment of the buckle assembly according to the invention.

Referring now in detail to the drawings, FIG. 1 shows a first embodiment of the buckle assembly according to the invention. Buckle assembly 10 comprises a housing 11 with four side openings 12 through which four male buckle portions 20 are inserted. Each male buckle portion 20 has strap retaining bars 22, 23 and a locking leg 24. Each locking leg 24 has a locking pawl 25 located on its distal end. Inside housing 11 is an actuating device 30, which is held in place by springs 36. Actuating device 30 consists of four latching mechanisms in the form of arms 33 which have catches 34. Catches 34 interact with locking pawls 25 to lock male buckle portions 20 inside housing 11 when male buckle portions 20 are inserted through side openings 12.

Figure 2:
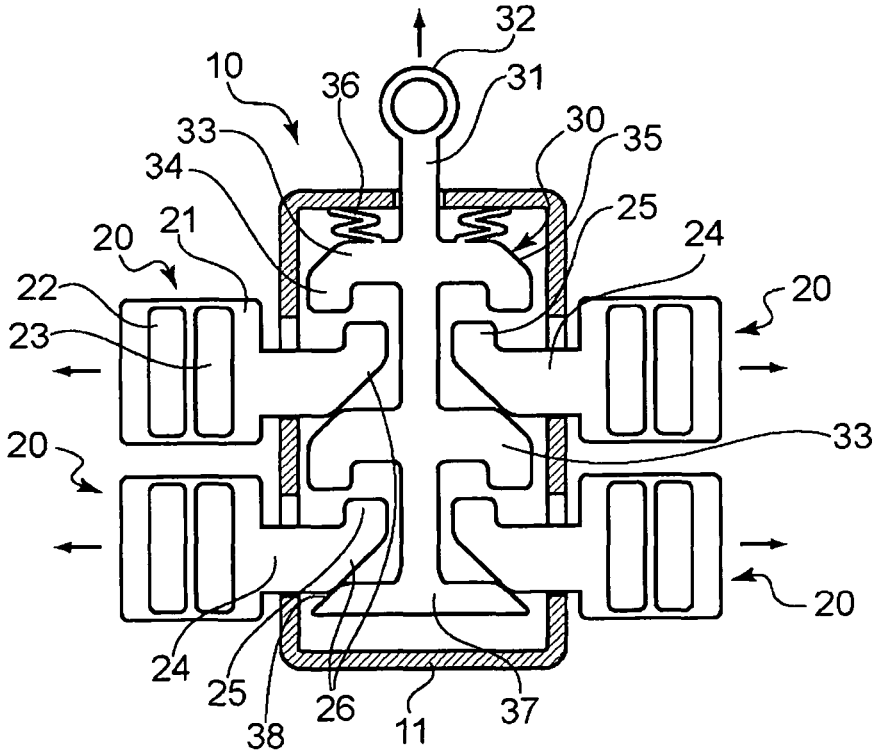
FIG. 2 shows the buckle assembly of FIG. 1 in a released position.

To release male buckle portions 20, the user pulls upward on handle 32 which is mounted on neck 31 of actuating device 30. This causes springs 36 to compress and causes arms 33 with catches 34 to move upward and out of engagement with locking pawls 25. At the same time, shoulder elements 35 on lower arms 34 and shoulder elements 38 on bottom section 37 move upward and slide against slanted sections 26 of locking legs 24. This sliding motion propels male buckle portions 20 outward to eject male buckle portions 20 from housing 11, as shown in FIG. 2.

Figure 3:
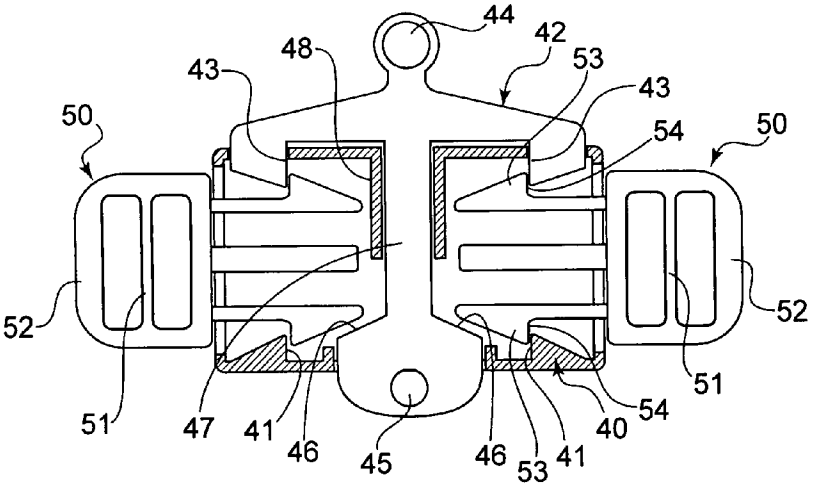
FIG. 3 shows a front cross-sectional view of another embodiment of the buckle assembly according to the invention.
Figure 4:
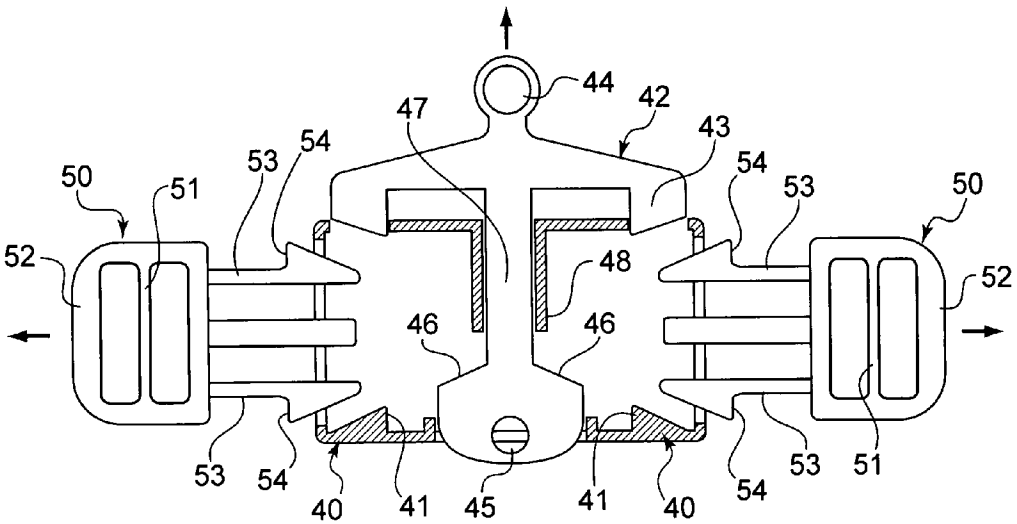
FIG. 4 shows the buckle assembly of FIG. 3 in a released position.

An alternative embodiment of the buckle assembly is shown in FIGS. 3 and 4. Here, there are two male buckle portions 50, each with strap securing bars 51, 52. Male buckle portions 50 each have two locking legs 53 with a locking pawl 54 on the end of each locking leg. Actuating device 42 is mounted inside housing 40 and protrudes through both the bottom and top of housing 40. Actuating device 42 has a central leg 47 onto which side arms with latching mechanism 43 are disposed on the top side, and shoulder elements 46 are disposed on the bottom side. A handle 44 is located at the top of actuating device 42. Inserting male buckle portions 50 into housing 40 causes locking pawls 54 to snap into engagement with latching mechanism 43 on the top, and catch 41 on housing 40 to engage on the bottom, as shown in FIG. 3. To release male buckle portions 50, handle 44 is pulled upward, as shown in FIG. 4, which moves latching mechanism 43 out of engagement with the upper locking leg 53. At the same time, shoulder elements 46 press upward on locking pawl 54 on the lower locking leg 53 and force male buckle portions 50 outward and away from housing 40. Actuating device 42 is maintained within housing 40 via guide rails 48 on housing 40. Actuating device 42 can slide up and down but is prevented from lateral movement by guide rails 48.

One advantage of the embodiment shown in FIGS. 3 and 4 is that multiple buckle assemblies can be connected together and actuated simultaneously with a single pull. To do this, handle 44 on one actuating mechanism is connected to a bottom of an adjacent actuating mechanism via aperture 45 by any conventional means, such as a screw. This way, pulling upward on a first actuating mechanism will also pull any connected actuating mechanisms and release all male buckle portions for any of the connected assemblies.

Figure 5:
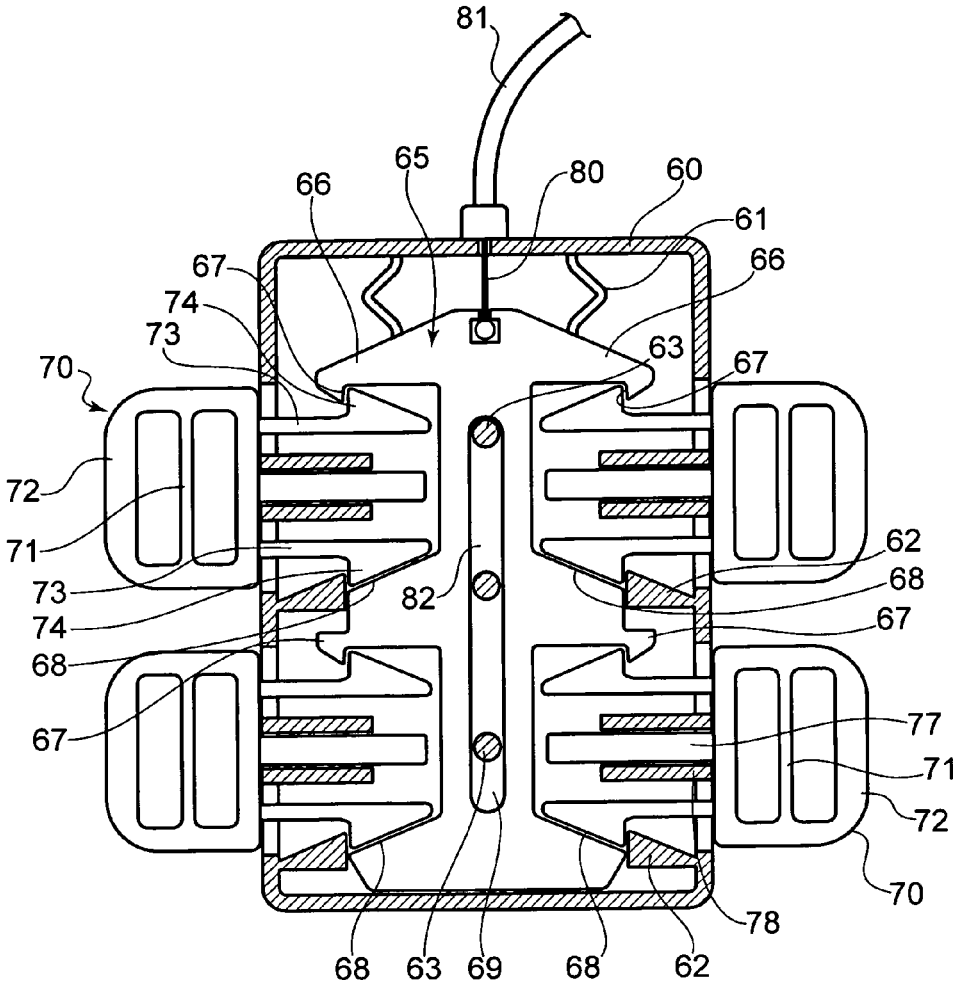
FIG. 5 shows a front cross-sectional view of another embodiment of the buckle assembly according to the invention.
Figure 6:
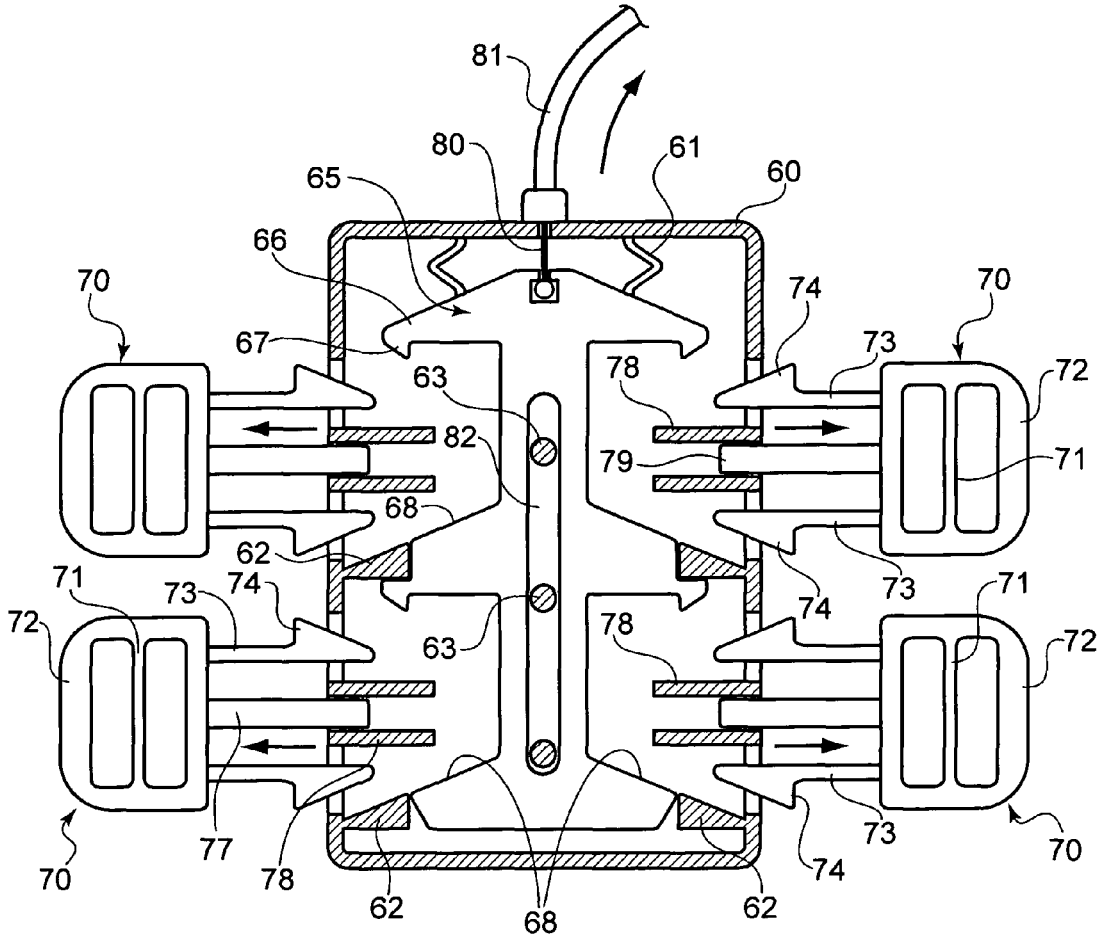
FIG. 6 shows the buckle assembly of FIG. 5 in a released position.

Yet another embodiment of the buckle assembly is shown in FIGS. 5 and 6. Here, there are four male buckle portions 70 that are inserted into housing 60. Actuating device 65 is mounted entirely within housing 60 and is actuated by pulling a cable 80 that extends through an aperture in the top of housing 60. Cable 80 is covered by a cable sheath 81 on the exterior of housing 60 and slides within cable sheath 81 when cable 80 is pulled. Springs 61 keeps actuating device 65 biased in housing 60 so that male buckle portions 70 snap into actuating device 65 and are retained there until cable 80 is pulled. Latching mechanisms 67 on arms 66 interact with locking pawls 74 on the upper legs of male buckle portions 70 and stops 62 catch on locking pawls 74 of the lower legs of male buckle portions 70. Male buckle portions 70 are guided into housing 60 via guides 78, which receive central leg 77 of each of male buckle portions 70. This prevents male buckle portions 70 from being inserted in a tilted or off-center manner, and ensures secure locking of male buckle portions 70 in housing 60.

Actuating device 65 is retained in place inside housing 60 by a set of guide pins 63 that extend through a slot 82 in actuating device 65. Actuating device 65 can slide along guide pins 63, but is prevented from lateral movement.

Pulling cable 80 causes actuating device to move upward, thus freeing locking pawls 74 from latching mechanisms 67 and stops 62. At the same time, shoulders 68 slide along locking pawls 74 and push male buckle portions out of housing 60, as shown in FIG. 6.

Figure 7:
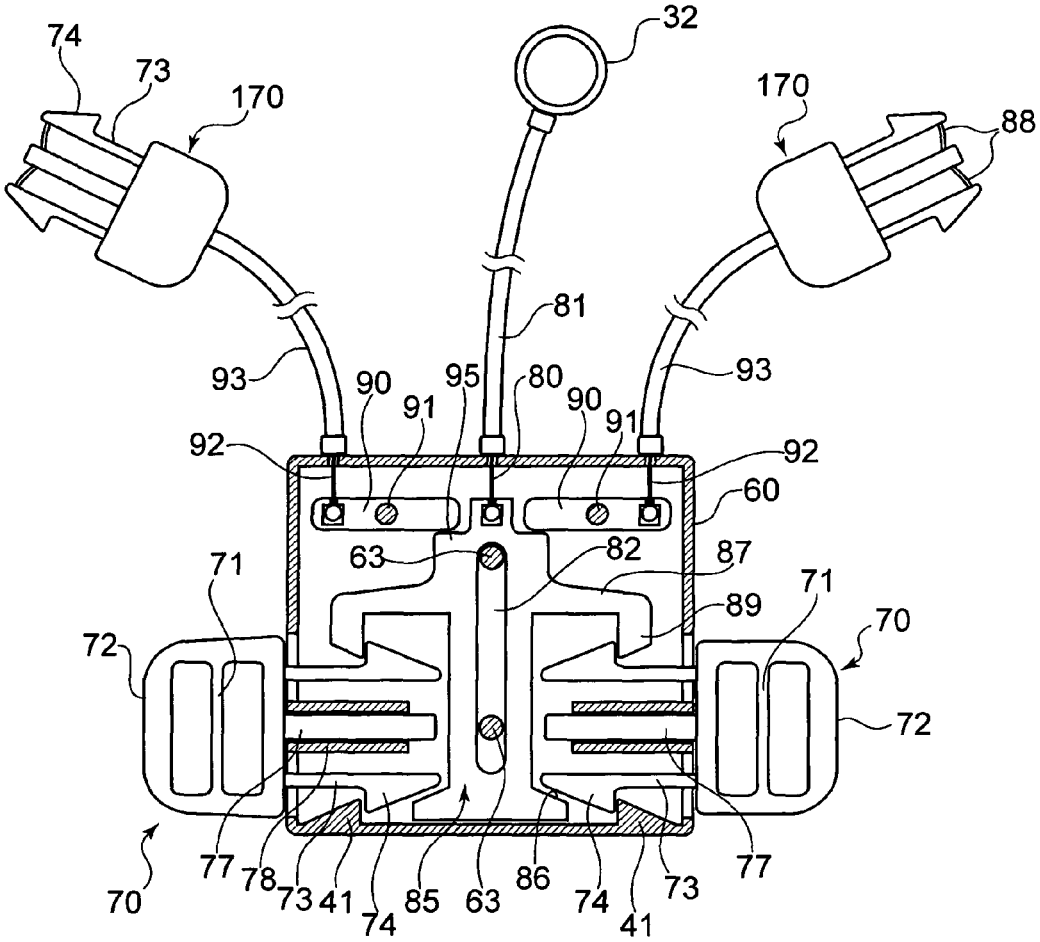
FIG. 7 shows a front cross-sectional view of another embodiment of the buckle assembly according to the invention.
Figure 8:
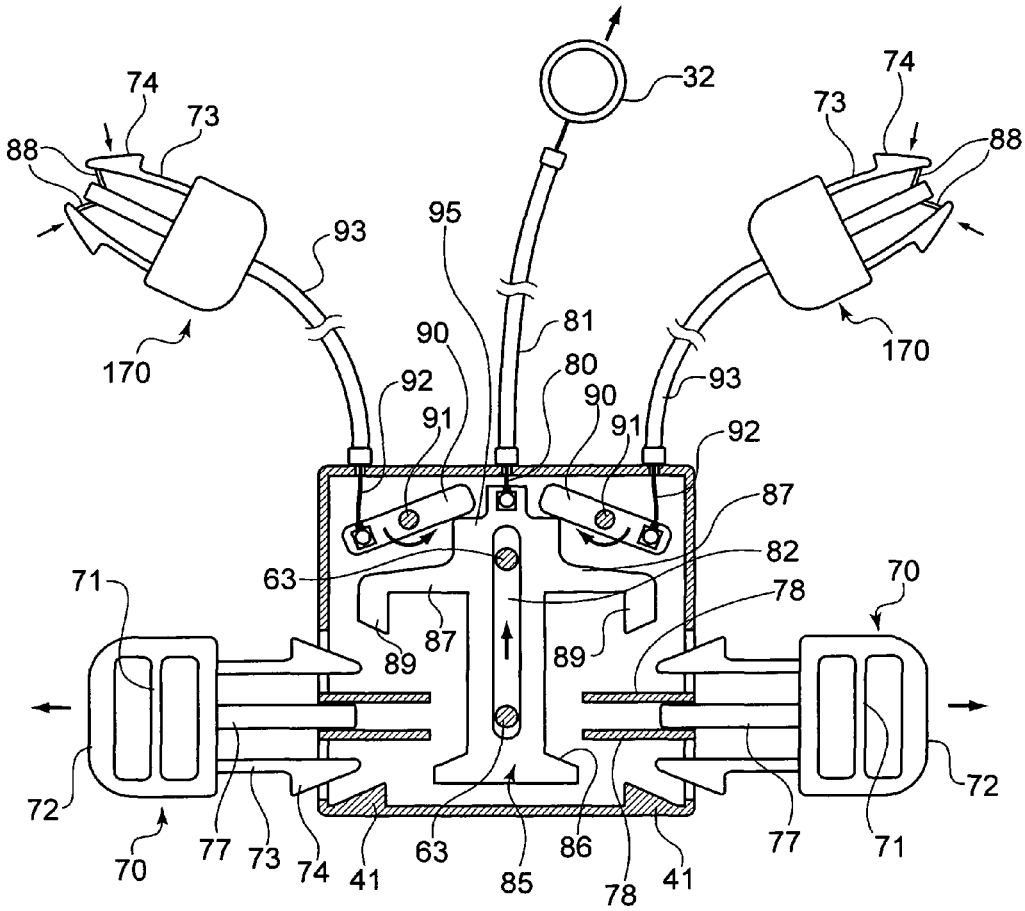
FIG. 8 shows the buckle assembly of FIG. 7 in a released position.

Another embodiment is shown in FIGS. 7 and 8. Here, two male buckle portions 70 are inserted into housing 60, and are held in place by latching mechanisms 89 on the top and catches 41 on the bottom, which interact with locking pawls 74 on locking legs 73 of male buckle portions 70. Pulling upward on handle 32 pulls cable 80 disposed inside cable sheath 81 and moves actuating device 85 upward. This causes locking legs 73 of male buckle portions 70 inside housing 60 to be released from latching mechanisms 89 and catches 41, in the same manner as described above with respect to the embodiment of FIGS. 5 and 6. At the same times, shoulders 86 slide along locking pawls 74 of the lower locking leg and force male buckle portions 70 out of housing 60. Guide pins 63 which extend through slot 82 in actuating device 85 keep actuating device 85 oriented properly in housing 60.

In this embodiment, two additional male buckle portions 170 are also moved by pulling on handle 32. Here, male buckle portions 170 are connected to a cable 92 inside cable sheath 93. Cable 92 is connected to one end of a lever 90 mounted on a fulcrum 91 inside housing 60. Pulling handle 32 causes shoulders 95 of actuating mechanism 85 to press against levers 90 and cause levers 90 to rotate, thus forcing the distal ends of levers 90 downward, as shown in FIG. 8. This in turn pulls cables 92 and thus buckles 170. Buckle 170 can be configured so that pulling on cable 92 acts to release buckles 170 from a corresponding female buckle portion. The exact mechanism for this release is described in U.S. patent application Ser. No. 12/456,069 to Anscher, the disclosure of which is herein incorporated by reference.

Figure 9:
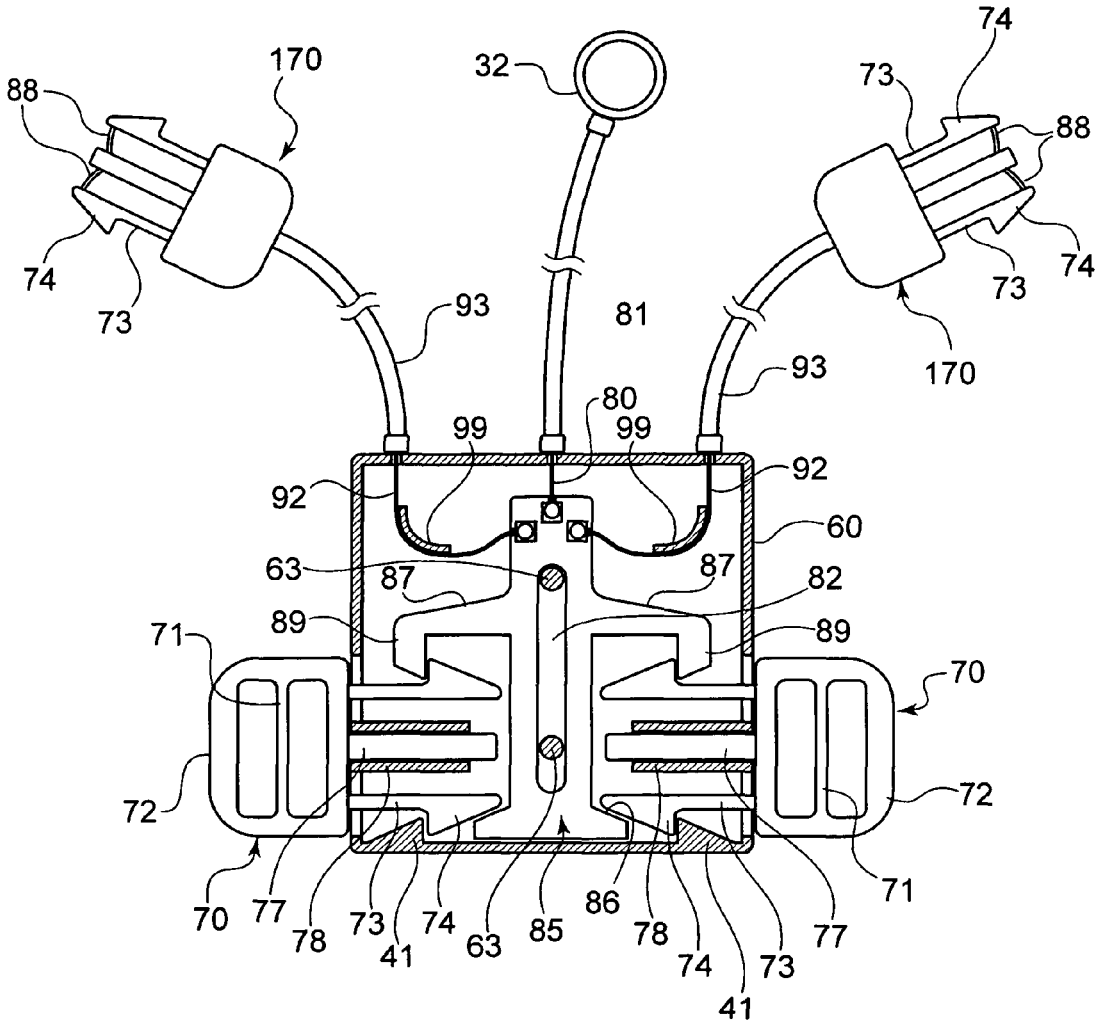
FIG. 9 shows a front cross-sectional view of another embodiment of the buckle assembly according to the invention.
Figure 10:
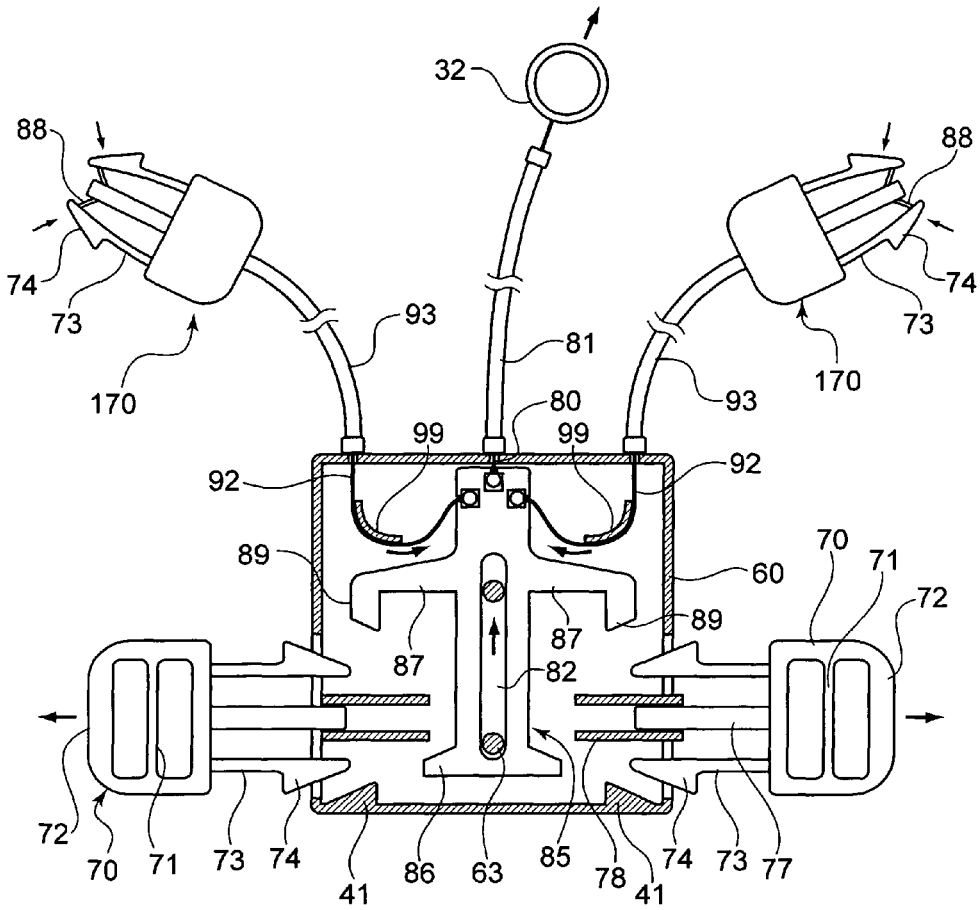
FIG. 10 shows the buckle assembly of FIG. 9 in a released position.

Yet another embodiment of the invention is shown in FIGS. 9 and 10. This embodiment is similar to the embodiment shown in FIGS. 7 and 8, except that instead of levers 90, curved cable guides 99 are mounted inside housing 60. Cables 92 are connected directly to actuating device 85 and extend around cable guides 99. Pulling upward on handle 32 forces male buckle portions 70 out of housing 60 in the same manner as described above with respect to the previous embodiments. In addition, pulling upward on handle 32 also pulls cables 92, which slide around cable guides 99. This pulling motion thus also pulls male buckle portions 170 and allows them to be released from a corresponding female buckle portion.

The embodiments shown in FIGS. 7-10 are useful on items like a tactical cut-away vest that must be removed quickly and easily. In this embodiment, male buckle portions 70 could hold the lower part of the vest together via straps on male buckle portions 70, and male buckle portions 170 could be used to secure the shoulder sections of the vest together when attached to corresponding female buckle portions. Pulling on handle 32 would then release all four buckle portions at the same time to allow the two sides of the vest to separate from each other.

Figure 11:
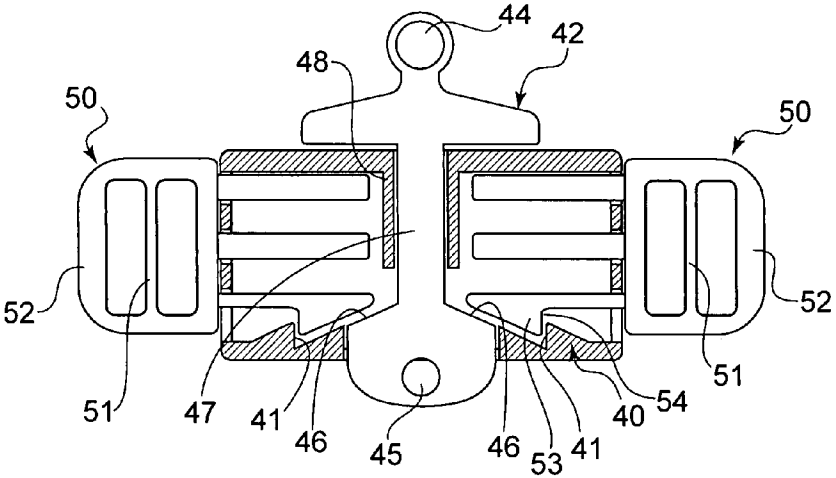
FIG. 11 shows a front cross-sectional view of another embodiment of the buckle assembly according to the invention.
Figure 12:
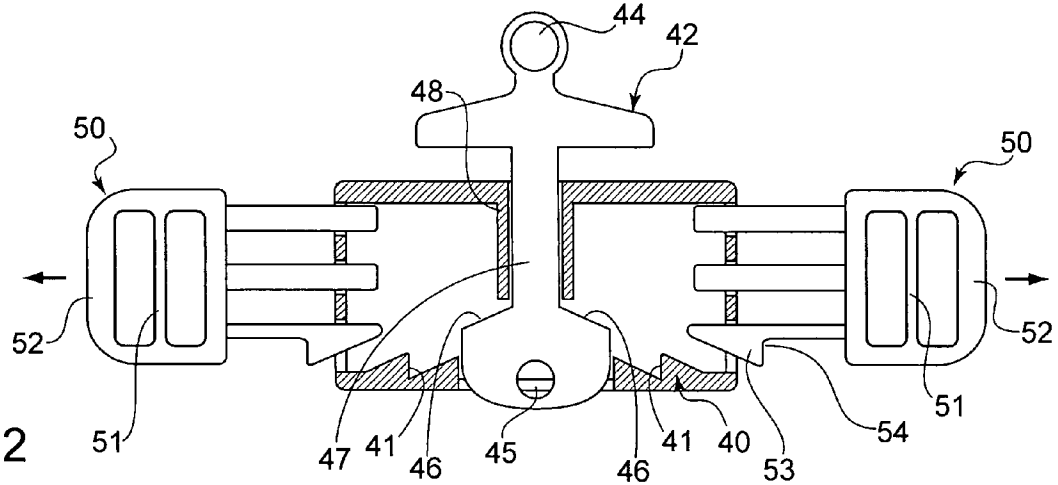
FIG. 12 shows the buckle assembly of FIG. 11 in a released position.

Yet another embodiment is shown in FIGS. 11 and 12. This embodiment is similar to the embodiment shown in FIGS. 3 and 4, except that there are no latching mechanisms on actuating device 42. Here, there are two male buckle portions 50, each with strap securing bars 51, 52. Male buckle portions 50 each have two locking legs 53 with a locking pawl 54 on the end of only the bottom locking leg, which interacts with catch 41 on housing 40. Actuating device 42 is mounted inside housing 40 and protrudes through both the bottom and top of housing 40. Actuating device 42 has a central leg 47 onto which side arms are disposed on the top side, and shoulder elements 46 are disposed on the bottom side. A handle 44 is located at the top of actuating device 42. Inserting male buckle portions 50 into housing 40 causes locking pawls 54 on the bottom legs 53 to snap into engagement with catch 41 on housing 40, as shown in FIG. 11. To release male buckle portions 50, handle 44 is pulled upward, as shown in FIG. 12, which moves shoulder elements 46 press upward on locking pawl 54 on the lower locking leg 53 to clear catch 41 and force male buckle portions 50 outward and away from housing 40.

Accordingly, while only a few embodiments of the present invention have been shown and described, it is obvious that many changes and modifications may be made thereunto without departing from the spirit and scope of the invention.

What is claimed is:

1. A buckle assembly comprising:

a female buckle portion having a housing with a hollow interior and at least two openings;

at least two male buckle portions, each of said male buckle portions having at least one locking leg;

an actuating device disposed within the housing and accessible through an aperture in the housing; and at least two latching mechanisms formed on the actuating device for cooperating with the locking legs for locking the male buckle portions to the actuating device within the female buckle portion when the locking legs of the male portions are inserted through the openings of the housing, wherein pulling the actuating device toward the aperture causes the latching mechanisms to separate from the locking legs to release the male buckle portions from the housing.

2. The buckle assembly of claim 1, wherein the actuating device further comprises at least one sliding surfaces that slide against the male buckle portions when the actuating device is pulled, to push the male buckle portions out of the female buckle portion.

3. The buckle assembly according to claim 2, further comprising additional latching mechanisms disposed in the housing, one opposite each of the latching mechanisms on the actuating device, such that inserting the male buckle portions through the openings causes the latching mechanisms on the actuating device to engage one side of each male buckle portion, and latching mechanisms on the housing to engage an opposite side of each male buckle portion.

4. The buckle assembly according to claim 3, wherein the sliding surfaces push the male buckle portions out of engagement with the latching mechanisms on the housing when the actuating device is pulled.

5. The buckle assembly of claim 1, wherein each locking leg has a locking pawl on a free end, and wherein the latching mechanisms each comprise a protrusion that interacts with a respective one of the locking pawls to prevent the male buckle portion from exiting the female buckle portion.

6. The buckle assembly according to claim 1, further comprising at least one spring disposed within the housing, said at least one spring pressing the actuating device away from the aperture, so that the male buckle portions snap into and engage the actuating device when the male buckle portions are inserted through the openings.

7. The buckle assembly according to claim 1, wherein there are four male buckle portions, four openings in the housing, and four latching mechanisms on the actuating device, such that pulling the actuating device releases all four male portions simultaneously.

8. The buckle assembly according to claim 1, wherein the housing has a second aperture opposite the aperture, and wherein the actuating device has means for connecting a second actuating device thereto, such that pulling on one actuating device also pulls the second actuating device.

9. The buckle assembly according to claim 1, further comprising at least one guide pin mounted to the housing, said at least one guide pin extending through a channel in the actuating device, and wherein pulling the actuating device causes the channel to slide along the at least one guide pin, to keep the actuating mechanism centered in the housing.

10. The buckle assembly according to claim 1, further comprising a cable connected to the actuating device, said cable extending through the aperture, such that pulling the cable pulls the actuating device.

11. The buckle assembly according to claim 1, further comprising at least one lever mounted within the housing, said lever having a fulcrum and two free ends, wherein one free end is connected to a cable and the other free end is disposed so that the actuating device contacts said other free end and pivots the lever around the fulcrum when the actuating device is pulled, thus pulling the cable.

12. The buckle assembly according to claim 11, wherein the cable is connected to an additional male buckle portion, such that pulling the actuating device pulls the additional male buckle portion connected to the cable.

13. The buckle assembly according to claim 12, wherein there are two of said levers, each lever being connected to one of said cables that is connected to one of said additional male buckle portions.

14. The buckle assembly according to claim 1, further comprising at least one cable connected to the actuating device, and extending through the housing, and at least one cable guide connected to the housing, the cable extending around the cable guide, wherein pulling the actuating device pulls the at least one cable and causes the at least one cable to slide along the at least one cable guide.

15. The buckle assembly according to claim 14, further comprising an additional male buckle portion connected to the at least one cable.

16. The buckle assembly according to claim 14, wherein there are two of said cables, two of said cable guides, and one of said additional male buckle portions connected to each of said cables.

* * * * *